US012276440B2

(12) United States Patent
Liang et al.

(10) Patent No.: US 12,276,440 B2
(45) Date of Patent: Apr. 15, 2025

(54) TOOLING AND METHOD FOR FLEXIBLE THROUGH CONNECTION BETWEEN DOUBLE LINERS OF WATER HEATER

(71) Applicant: Qingdao University of Technology, Qingdao (CN)

(72) Inventors: Sen Liang, Qingdao (CN); Ruijun Sun, Qingdao (CN); Qinglun Che, Qingdao (CN); Long Wu, Sanming (CN)

(73) Assignee: Qingdao University of Technology, Qingdao (CN)

( * ) Notice: Subject to any disclaimer, the term of this patent is extended or adjusted under 35 U.S.C. 154(b) by 158 days.

(21) Appl. No.: 18/354,871

(22) Filed: Jul. 19, 2023

(65) Prior Publication Data

US 2023/0358442 A1 Nov. 9, 2023

(30) Foreign Application Priority Data

Jan. 16, 2023 (CN) ..... 202310073932.8

(51) Int. Cl.

| | |
|---|---|
| ***F24H 9/14*** | (2006.01) |
| ***F24H 1/18*** | (2022.01) |
| ***F24H 9/00*** | (2022.01) |

(52) U.S. Cl.

CPC ..... *F24H 9/14* (2013.01); *F24H 1/181* (2013.01); *F24H 9/0005* (2013.01)

(58) Field of Classification Search

CPC ... F24H 1/181; F24H 9/00; F24H 9/02; F24H 9/18; F24H 9/0005

See application file for complete search history.

(56) References Cited

FOREIGN PATENT DOCUMENTS

| | | | |
|---|---|---|---|
| CN | 203629033 U | | 6/2014 |
| CN | 205174832 U | * | 4/2016 |
| CN | 208382579 U | * | 1/2019 |
| CN | 212205046 U | * | 12/2020 |
| CN | 215571221 U | * | 1/2022 |
| CN | 114440460 A | | 5/2022 |
| CN | 217082937 U | * | 7/2022 |
| CN | 217082938 U | * | 7/2022 |
| CN | 217604343 U | * | 10/2022 |
| CN | 219014648 U | * | 5/2023 |
| CN | 219624257 U | * | 9/2023 |
| CN | 219797506 U | * | 10/2023 |
| CN | 118998991 A | * | 11/2024 |
| CN | 222123475 U | * | 12/2024 |

* cited by examiner

*Primary Examiner* — Gregory A Wilson

(57) ABSTRACT

A tooling and method for flexible through connection of a double-liner water heater. The tooling includes a transition shaft, a tooling connecting plate and a fastening screw. The method includes: allowing a shaft head of the transition shaft to be in fit with an inner surface of an outer flange of a lower liner for welding; allowing an end hole to be in fit with an outer surface of an inner flange of an upper liner for welding; after welding seams are cooled, removing the tooling, and enameling the upper and liners; forming through-flexible connection between the inner and outer flanges; and firmly fitting the upper and lower liners together with two steel strips to ensure that a gap between the upper and lower liners is not greater than 7 mm.

10 Claims, 6 Drawing Sheets

TOOLING AND METHOD FOR FLEXIBLE THROUGH CONNECTION BETWEEN DOUBLE LINERS OF WATER HEATER

CROSS-REFERENCE TO RELATED APPLICATIONS

This application claims the benefit of priority from Chinese Patent Application No. 202310073932.8, filed on Jan. 16, 2023. The content of the aforementioned application, including any intervening amendments thereto, is incorporated herein by reference in its entirety.

TECHNICAL FIELD

The disclosure relates to household water heaters, and more specifically to a tooling and method for flexible through connection between double liners of a water heater.

BACKGROUND

Double-liner electric water heater is a structurally- and functionally-new storage electric water heater developed based on the single-liner water heater. The double-liner electric water heater is energy-saving and fast in heating speed, can simultaneously store cold water and hot water, and has large water storage capacity, satisfying different requirements according to actual conditions.

At present, the existing double-liner electric water heater includes an upper liner and a lower liner connected through a connecting part, that is, the upper liner and the lower liner each are welded to a connecting pipe, and then assembled into the entire part. Unfortunately, the gap between the upper liner and the lower liner is large (larger than 30 mm), resulting in large size and excessive space occupation. In addition, a water-passing hole of the connecting pipe is thin and long, such that the subsequent integral enamel process is difficult, water leakage and water seepage are easy to occur, and the service life of a welding seam is reduced.

Regarding the compact connection, (that is, a gap between the upper and lower liners is less than or equal to 7 mm), there is no operation space, and thus it is unable to weld.

SUMMARY

In order to solve the above-mentioned technical problems, the disclosure provides a tooling and method for flexible through connection between double liners of a water heater. It realizes a connection with a gap two liners less than or equal to 7 mm. A water-passing connecting pipe is short, and an inner hole thereof is easy to enamel. Water-passing holes of the upper liner and the lower liner are centered after welding, contributing to utilization of the double-liner structure.

Technical solutions of this application are described as follows.

In a first aspect, this application provides a tooling for flexible through connection of a double-liner water heater, comprising:

a transition shaft;

a tooling connecting plate; and a hexagon socket set screw with cone point;

wherein two ends of the tooling connecting plate are each provided with a through hole; a transition shaft is arranged in the through hole; the transition shaft is in clearance fit with the tooling connecting plate, and the transition shaft is screwedly fastened to the tooling connecting plate;

an upper part of the transition shaft is provided with an end hole; the end hole is in tight centering clearance fit with an outer surface of an inner flange of an upper liner; a lower part of the transition shaft is configured as a shaft head; and the shaft head is in tight centering clearance fit with an inner surface of an outer flange of a lower liner; and a fitting length between the shaft head of the transition shaft and the outer flange and a fitting length between the end hole of the transition shaft and the inner flange are set such that the gap between the lower liner and the upper liner satisfies a welding process requirement.

In a second aspect, this application provides a method for flexible through connection of a double-liner water heater by using the above-mentioned tooling, wherein a gap between the upper liner and the lower liner is less than or equal to 7 mm, and the method comprises:

(a) allowing the shaft head to be in centering clearance fit with an inner surface of the outer flange; and allowing the end hole to be in centering clearance fit with an outer surface of the inner flange;

(b) adjusting a position of the tooling such that the inner flange is aligned with a first welding assembly hole on the upper liner, and the outer flange is aligned with a second welding assembly hole on the lower liner; welding the inner flange with the first welding assembly hole, and welding the outer flange with the second welding assembly hole;

wherein a first welding seam formed from the welding of the inner flange with the first welding assembly hole is located at an outer side of the upper liner; a second welding seam formed from the welding of the outer flange and the second welding assembly hole is located at an outer side of the lower liner; a central axis of the first welding assembly hole and a central axis of the second welding assembly hole are kept on the same line; and central axes of the transition shaft, the end hole and the shaft head are collinear, and coincide with a central axis of the outer flange and a central axis the inner flange; and the fitting length between the shaft head of the transition shaft and the outer flange and the fitting length between the end hole of the transition shaft and the inner flange are set such that the gap between the lower liner and the upper liner satisfies a welding process requirement; and (c) after the first welding seam and the second welding seam are cooled to room temperature, removing the tooling; enameling the upper liner and the lower liner; connecting the outer surface of the inner flange to the inner surface of the outer flange in flexible through connection (which is performed by placing a first seal ring in a groove of a bottom surface of the inner flange, placing a second seal ring in a groove of a cylindrical surface of the inner flange, and inserting the inner flange into the outer flange); and firmly fitting the upper liner and the lower liner together by using two steel strips, wherein the two steel strips offer a pre-tightening force to ensure that the gap between the upper liner and the lower liner is less than or equal to 7 mm.

The first seal ring is arranged on the bottom surface of the inner flange, and the second seal ring is arranged on the cylindrical surface of the inner flange, which enhances the flexibility and reliability of the connection to prevent water leakage and seepage.

In some embodiments, in step (a), the bottom surface of the inner flange is provided with a recess structure to reduce the force-bearing area and increase the pressure, which improves the tightness to prevent water leakage and seepage.

In some embodiments, in step (a), the first welding assembly hole and the inner flange are in clearance fit; the second welding assembly hole and the outer flange are in clearance fit.

In some embodiments, in step (a), a diameter of the tooling connection part is the same as a diameter of a flange connection part; the shaft head of the transition shaft and the outer flange are in tight centering clearance fit with excellent precision, and the end hole of the transition shaft and the inner flange are in tight centering clearance fit with excellent precision, such that the gap between the upper liner and the lower liner satisfies the welding process requirement.

In some embodiments, in step (a), a center distance between two transition shafts is equal to a center distance of water-passing holes of the upper liner and the lower liner.

In some embodiments, in step (a), the transition shaft is fixed to the tooling connecting plate by using the hexagon socket set screw with cone point, so as to ensure that the transition shaft and the tooling connecting plate are in centering clearance fit.

In some embodiments, in step (a), the inner flange in fitting manner with the end hole of the transition shaft is welded to the upper liner; and the outer flange in fitting manner with the shaft head of the transition shaft is welded to the lower liner.

In some embodiments, in step (a), the end hole of the transition shaft of the dual liner through composite flexible connection tooling of the water heater is assembled and welded with the inner flange of the upper liner, and the shaft head of the transition shaft is assembled and welded with the outer flange of the lower liner.

In some embodiments, in step (a), the central axis of the first welding assembly hole and the central axis of the second welding assembly hole are located in the same line; central axes of the transition shaft, the end hole and the shaft head coincide with each other, and coincide with a central axis of the outer flange and a central axis of the inner flange.

In some embodiments, in step (a), the bottom surface of the inner flange is matched with a bottom surface of the outer flange; and the bottom surface of the inner flange is perpendicular to the central axis of the inner flange, and the bottom surface of the outer flange is perpendicular to the central axis of the outer flange. During assembling the inner flange and the outer flange, the first seal ring is arranged on the bottom surface of the inner flange, and the second seal ring is arranged on the cylindrical surface of the inner flange, which enhances flexibility and reliability to prevent water leakage and seepage.

Compared to the prior art, this application has the following beneficial effects.

The tooling and method for flexible through connection provided herein realize a tight connection of the double-liner water heater, which is within 7 mm, avoiding a large gap between the two liners and reducing space occupation. The length of the water-passing hole is reduced, which simplifies the enamel process, prevent water leakage and seepage at the connection part, and greatly extending the service life of welding seams. This application provides a method for small gap connection between two liners, that is, provides the tooling and method for flexible through connection, which forms a great weld joint, ensures the welding strength and improves general mechanics of weld joint. The length of the water-passing hole is significantly reduced to perfect and simplify the enamel process. The tooling and method provided herein can be used in industrial production, and can improve the processing and assembly efficiency. The double-liner water heater can avoid water leakage and seepage after 300000 tests under a pulsating cyclic load of 10 atmospheres, allowing for high reliability.

BRIEF DESCRIPTION OF THE DRAWINGS

In order to explain the technical solutions of the present disclosure more clearly, the accompanying drawings needed in the description of the embodiments of the present disclosure will be briefly described below. Obviously, presented in the accompany drawings are merely some embodiments of the present disclosure, which are not intended to limit the disclosure.

Figure 1:
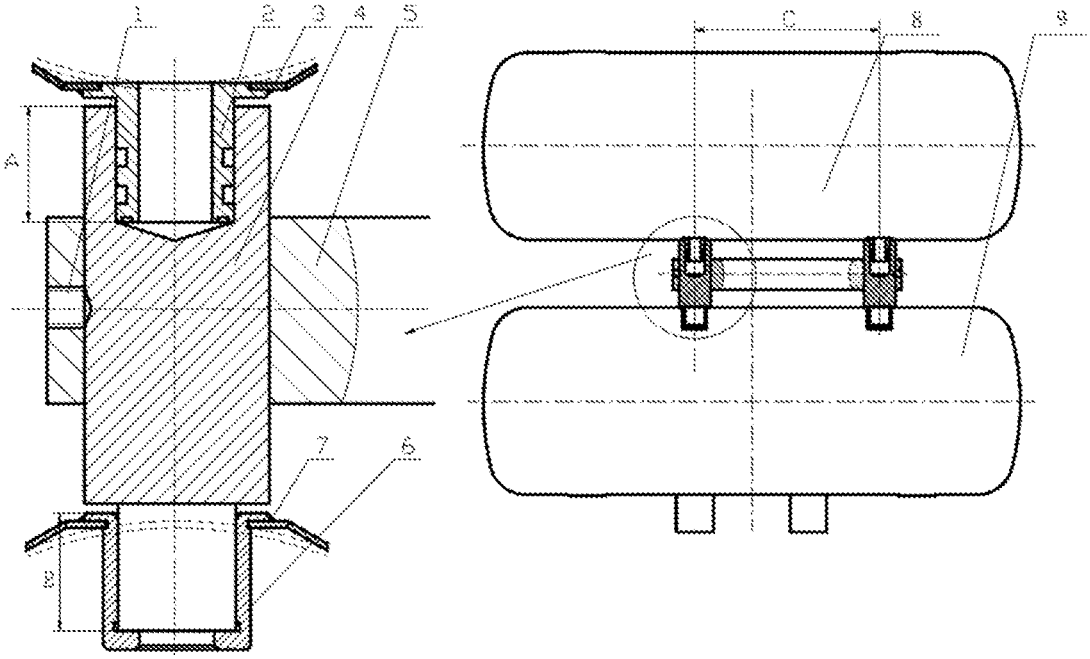
FIG. 1 shows an using state of a tooling for an outer flange and an inner flange of a double-liner electric water heater according to an embodiment of the present disclosure.

In the drawings: 1, hexagon socket set screw with cone point; 2, inner flange; 3, first welding seam (the seam between first welding assembly hole in upper liner and inner flange); 4, transition shaft; 5, tooling connecting plate; 6, outer flange; 7, second welding seam (the seam between second welding assembly hole in lower liner and outer flange); 8, upper liner; 9, lower liner; 10, first seal ring; 11, second seal ring; 12, steel strip; 13, end hole; 14, shaft head; B, fitting length between the shaft head of the transition shaft and the outer flange; A, fitting length between the end hole of the transition shaft and the inner flange; C, a center distance of water-passing holes; ϕD, the first welding assembly hole; and ϕE, the second welding assembly hole.

DETAILED DESCRIPTION OF EMBODIMENTS

Described below are merely illustrative of the disclosure, and are not intended to limit the disclosure. Unless otherwise specified, terms used herein have the same meaning as commonly understood by those skilled in the art.

It should be noted that terms used herein are only illustrative, but not to limit the scope of the present invention. Unless specified, a singular form also includes a plural form. In addition, it should also be understood that when the terms "comprise" and/or "include" are used in the description, one or combinations of features, steps, operations, devices, components are contained.

For ease of description, terms "up", "down", "left" and "right" refer to orientational or positional relationship shown in the drawings, which are merely for better description of the present disclosure instead of indicating or implying that the device or element referred to must have a specific orientation, be constructed and operated in a specific orientation. Therefore, these terms should not be construed as a limitation to the present disclosure.

In order to clearly illustrate the objects and technical solutions of the present invention, the present disclosure will be described below in detail with reference to the embodiments and FIGS. 1-6.

Figure 2:
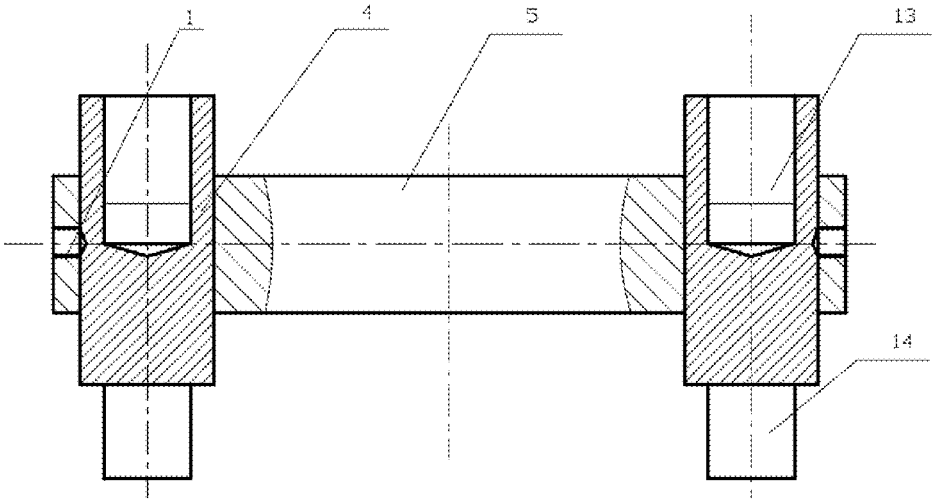
FIG. 2 is a schematic diagram of the welding tooling of outer flange and inner flange of the double-liner electric water heater according to an embodiment of the present disclosure.

Referring to FIGS. 1-2, this application provides a tooling for welding an outer flange and an inner flange of a double-liner water heater. The tooling includes a hexagon socket set screw with cone point 1, a transition shaft 4 and a tooling connecting plate 5. The tooling connecting plate 5 is configured to ensure a center distance between two transition shafts 4 to be equal to a center distance C of water-passing holes of the upper liner and the lower liner. The transition shaft 4 is in centering clearance fit with the tooling connecting plate 5. Two ends of the tooling connecting plate 5 are each provided with a through hole along a length direction of the tooling connecting plate 5. The through hole is provided with the transition shaft 4. Two transition shafts 4 are in clearance fit with the tooling connecting plate 5. The transition shafts 4 are fastened to the tooling connecting plate 5 through the hexagon socket set screw with cone point 1.

Specifically, centers of two end surfaces of the tooling connecting plate 5 are each provided with a screw hole along a length direction of the tooling connecting plate 5. The hexagon socket set screw with cone point 1 passes through a corresponding screw hole to fix the transition shaft 4 along a direction perpendicular to an axis of the transition shaft 4.

Referring to FIG. 1, an upper part of the transition shaft 4 is provided with an end hole 13. The end hole 13 is in tight centering clearance fit with an outer surface of an inner flange 2. A lower part of the transition shaft 4 is a shaft head 14. The shaft head 14 is in tight centering clearance fit with an inner surface of an outer flange 6. The inner flange 2 is welded to an upper liner 8 of the double-liner electric water heater, which forms a first welding seam 3. The outer flange 6 is welded to a lower liner 9 of the double-liner electric water heater, which forms a second welding seam 7. A fitting length B between the shaft head 14 of the transition shaft 4 and the outer flange 6 and a fitting length A between the end hole 13 of the transition shaft 4 and the inner flange 2 are set such that a distance between the lower liner 9 and the upper liner 8 satisfies the welding process requirement. A central axis of a first welding assembly hole ϕD of the upper liner 8 and a central axis of a second welding assembly hole ϕE of the lower liner 9 are kept on the same line. The first welding assembly hole ϕD is configured to be welded with the inner flange 2. The second welding assembly hole ϕE is configured to be welded with the outer flange 6. Central axes of the transition shaft 4, the end hole 13 and the shaft head 14 are collinear, and coincide with a central axis of the outer flange 6 and a central axis of the inner flange 2.

Figure 3:
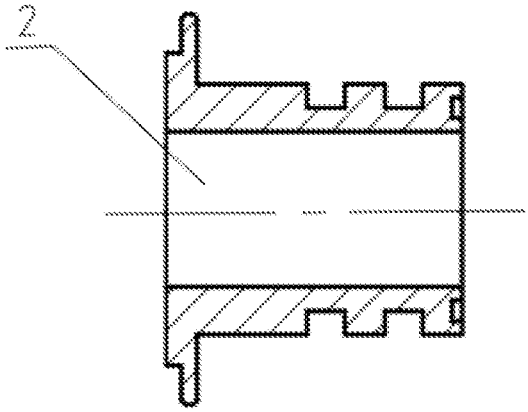
FIG. 3 schematically shows a structure of the inner flange of the double-liner electric water heater according to an embodiment of the present disclosure.

The inner flange 2 of the double-liner electric water heater is shown in FIG. 3. The inner flange 2 has a through-hole structure. A cylindrical surface of the inner flange 2 is provided with a first groove. An end of the inner flange 2 fitting with the transition shaft 4 is provided with a second groove. The outer diameter of the first groove is larger than that of the second groove. The first groove is matched with a second seal ring 11. The second groove is matched with a first seal ring 10. The outer diameter of the first seal ring 10 is smaller than that of the second seal ring 11. An end of the inner flange 2 fitting with the upper liner 8 extends outward to facilitate welding between the inner flange 2 and the upper liner 8.

Figure 4:
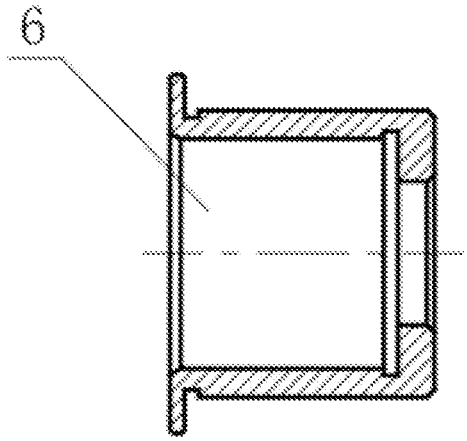
FIG. 4 schematically shows a structure of the outer flange of the double-liner electric water heater according to an embodiment of the present disclosure.

The outer flange 6 of the double-liner electric water heater is shown in FIG. 4. The outer flange 6 has a through-hole structure. An end of the outer flange 6 extends inward to facilitate the welding between the outer flange 6 and the lower liner 9.

Figure 5:
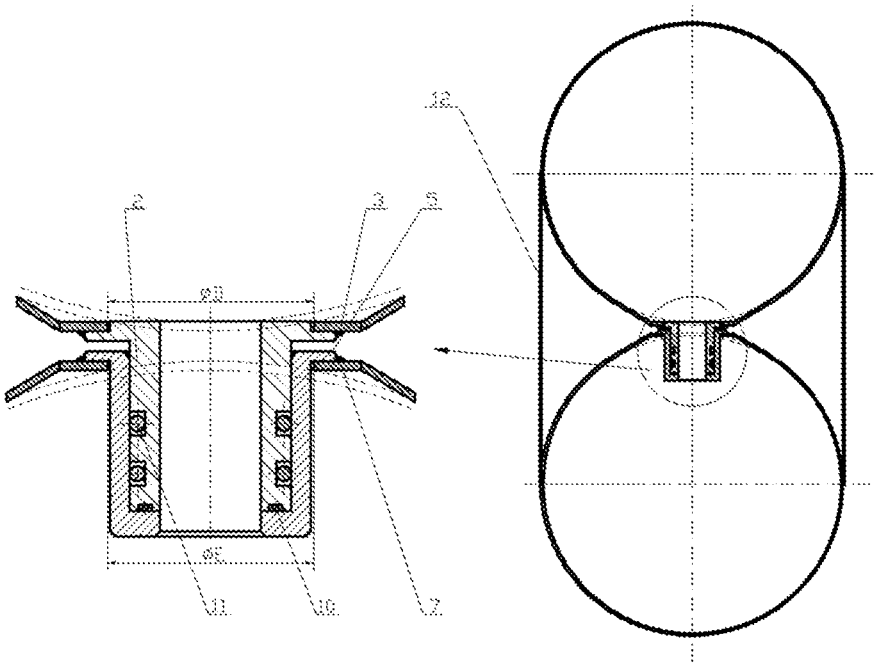
FIG. 5 schematically shows flexible through connection of the through-type double-liner electric water heater, in which an upper liner and a lower liner are communicated.

In an embodiment, two flange assemblies between the upper liner and the lower liner adopt a flexible through connection, shown as FIG. 5. Each flange assembly includes an inner flange and an outer flange. The second seal ring 11 is arranged on the cylindrical surface of the inner flange 2 which is matched with the outer flange 6. A bottom surface of the inner flange 2 is matched with a bottom surface of the outer flange 6. The bottom surface of the inner flange 2 is perpendicular to a central axis of the inner flange 2. The bottom surface of the outer flange 6 is perpendicular to a central axis of the outer flange 6. The first seal ring 10 is arranged at the bottom surface of the inner flange 2 fit with the outer flange 6. Two steel strips 12 are configured to firmly fit the upper liner 8 and the lower liner 9 together.

Figure 6:
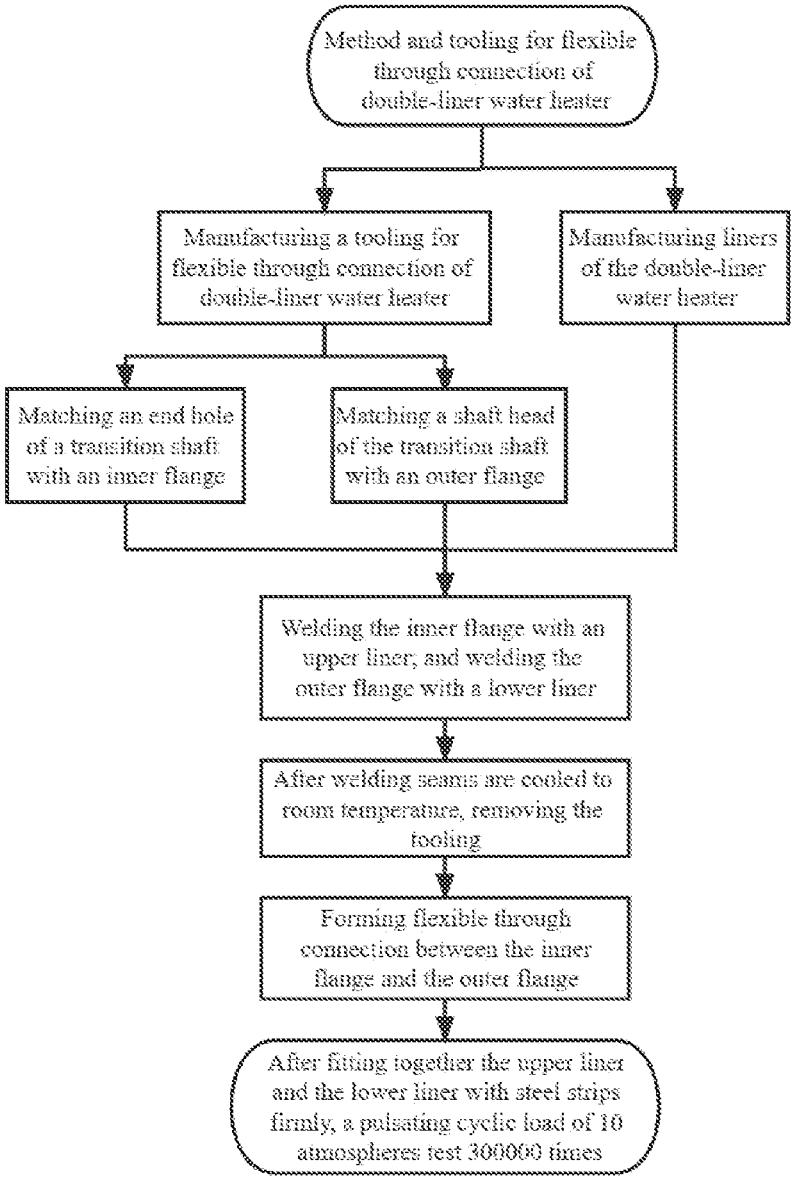
FIG. 6 is a flow chart of processing, welding and assembly of main parts of the double-liner electric water heater according to an embodiment of the present disclosure.

FIG. 6 shows a flow chart of processing, welding and assembly of main parts of the double-liner electric water heater, including processing the upper liner 8, the lower liner 9, the inner flange 2 and the outer flange 6, and the tooling. Referring to FIG. 1, with the assistance of the tooling provided herein, the inner flange 2 is aligned with the upper liner 8 and then welded through the first welding seam 3, and the outer flange 6 is aligned with the lower liner 9 and then welded through the second welding seam 7. After the first welding seam 3 and the second welding seam 7 are cooled to room temperature, the tooling is removed. The upper liner 8 and the lower liner 9 are enameled. Then, an outer surface of the inner flange 2 is in flexible connection with an inner surface of the outer flange 6, in which one first seal ring 10 and two second seal rings 11 are sealed. The upper liner 8 and the lower liner 9 are firmly fitted together by using two steel strips 12, in which each steel strip 12 provides a pre-tightening force of 350-500 kg. Finally, the double-liner electric water heater is subjected to a seal leakage test under a pulsating cyclic load.

Provided is a method for flexible through connection of the double-liner water heater, which is performed by using the above-mentioned tooling. A gap between the upper liner and the lower liner is less than or equal to 7 mm. The method includes the following steps.

(S1) The inner flange 2 to be weld with the upper liner 8 is aligned with the outer flange 6 to be welded with the lower liner 9 by adjusting a position of the tooling shown in FIG. 1. That is, the shaft head 14 of the transition shaft 4 is in tight centering clearance fit with the inner surface of the outer flange 6 of the lower liner 9. The end hole 13 of the transition shaft 4 is in tight centering clearance fit with the outer surface of the inner flange 2 of the upper liner 8. The fitting length B between the shaft head 14 of the transition shaft 4 and the outer flange 6 and the fitting length A between the end hole 13 of the transition shaft 4 and the inner flange 2 are set such that the gap between the lower liner 9 and the upper liner 8 satisfies the welding process requirement.

(S2) The inner flange 2 is aligned with the first welding assembly hole ϕD of the upper liner 8 and welded, which forms the first welding seam 3 at an outer side of the upper liner 8. The outer flange 6 is aligned with the second welding assembly hole ϕE of the lower liner 9 and welded, which forms the second welding seam 7 at an outer side of the lower liner 9.

(S3) After the first welding seam 3 and the second welding seam 7 are cooled to room temperature, the tooling is removed. The upper liner 8 and the lower liner 9 are enameled. Then, the outer surface of each inner flange 2 is in flexible connection with the inner surface of each outer flange 6. During assembling the inner flange 2 and the outer flange 6, the first seal ring 10 is placed on the bottom surface of the inner flange 2, and the second seal ring 11 is placed on the cylindrical surface of the inner flange 2, which enhances the flexibility and reliability of the connection to prevent water leakage and seepage. The bottom surface of the inner flange 2 is provided with a recess structure to reduce the force-bearing area and increase a pressure, which improves the tightness to prevent water leakage and seepage.

(S4) The upper liner 8 and the lower liner 9 are firmly fitted together by using two steel strips 12. Each steel strip 12 provides a pre-tightening force of 350-500 kg, and the gap between the upper liner and the lower liner is less than or equal to 7 mm.

After the assembly, the double-liner water heater can avoid water leakage and water seepage after 300,000 tests under a pulsating cyclic load of 10 atmospheres.

Described above are merely illustrative of the disclosure, and are not intended to limit the disclosure. Although the disclosure has been illustrated and described in detail above, it should be understood that those skilled in the art could still make changes and modifications content to the embodiments content of the disclosure. Those changes, replacements and modifications content made by those skilled in the art based on the content disclosed herein without departing from the scope of the disclosure shall fall within the scope of the present disclosure defined by the appended claims.

What is claimed is:

1. A tooling for flexible through connection of a double-liner water heater, comprising:

a tooling connecting plate;

wherein the tooling is configured for connection of an upper liner and a lower liner of the double-liner water heater with a gap there between less than or equal to 7 mm; two ends of the tooling connecting plate are each provided with a through hole; a transition shaft is arranged in the through hole; the transition shaft is in clearance fit with the tooling connecting plate; and the transition shaft is screwedly fastened to the tooling connecting plate; and one end of the transition shaft is provided with an end hole, and the end hole is configured to fit an inner flange of the upper liner; and the other end of the transition shaft is configured as a shaft head fitting an outer flange of the lower liner.

2. The tooling of claim 1, wherein a center distance between two transition shafts is equal to a center distance of water-passing holes of the upper liner and the lower liner.

3. The tooling of claim 1, wherein the shaft head is in centering clearance fit with an inner surface of the outer flange; and the end hole is in centering clearance fit with an outer surface of the inner flange.

4. The tooling of claim 1, wherein the upper liner is provided with a first welding assembly hole, and the lower liner is provided with a second welding assembly hole; a central axis of the first welding assembly hole and a central axis of the second welding assembly hole are located in the same line; the first welding assembly hole is configured for welding assembly of the inner flange; and the second welding assembly hole is configured for welding assembly of the outer flange; and central axes of the transition shaft, the end hole and the shaft head coincide with each other, and coincide with a central axis of the outer flange and a central axis of the inner flange.

5. The tooling of claim 4, wherein the inner flange is welded to the upper liner; and the outer flange is welded to the lower liner.

6. The tooling of claim 4, wherein the first welding assembly hole and the inner flange are in clearance fit; the second welding assembly hole and the outer flange are in clearance fit.

7. The tooling of claim 1, wherein a fitting length between the shaft head of the transition shaft and the outer flange and a fitting length between the end hole of the transition shaft and the inner flange are set such that the gap between the lower liner and the upper liner satisfies a welding process requirement.

8. A method for flexible through connection of a double-liner water heater by using the tooling of claim 1, comprising:

(a) allowing the shaft head to be in centering clearance fit with an inner surface of the outer flange; and allowing the end hole to be in centering clearance fit with an outer surface of the inner flange;

(b) adjusting a position of the tooling such that the inner flange is aligned with a first welding assembly hole on the upper liner, and the outer flange is aligned with a second welding assembly hole on the lower liner; welding the inner flange with the first welding assembly hole, and welding the outer flange with the second welding assembly hole;

wherein a central axis of the first welding assembly hole and a central axis of the second welding assembly hole are kept on the same line; central axes of the transition shaft, the end hole and the shaft head are collinear, and coincide with a central axis of the outer flange and a central axis of the inner flange; a first welding seam formed from the welding of the inner flange with the first welding assembly hole is located at an outer side of the upper liner; and a second welding seam formed from the welding of the outer flange and the second welding assembly hole is located at an outer side of the lower liner; and (c) after the first welding seam and the second welding seam are cooled to room temperature, removing the tooling; enameling the upper liner and the lower liner; placing a first seal ring in a groove at a bottom surface of the inner flange, placing a second seal ring in a groove at a cylindrical surface of the inner flange; inserting the inner flange into the outer flange to realize flexible through connection between the lower liner and the upper liner; and firmly fitting the upper liner and the lower liner together by using two steel strips, wherein the two steel strips offer a pre-tightening force to ensure that the gap between the upper liner and the lower liner is less than or equal to 7 mm.

9. The method of claim 8, wherein the bottom surface of the inner flange is provided with a recess structure.

10. The method of claim 8, wherein the bottom surface of the inner flange is matched with a bottom surface of the outer flange; and the bottom surface of the inner flange is perpendicular to the central axis of the inner flange, and the bottom surface of the outer flange is perpendicular to the central axis of the outer flange.

* * * * *